US005626168A

United States Patent [19]

Garnett

[11] Patent Number: 5,626,168

[45] Date of Patent: May 6, 1997

[54] DOUBLE ROLLER ELEMENTS FOR JACQUARD MACHINES

[75] Inventor: David Garnett, Ilkley, England

[73] Assignee: BNL Limited, Knaresborough, England

[21] Appl. No.: 371,920

[22] Filed: Jan. 11, 1995

[30] Foreign Application Priority Data

Jan. 13, 1994 [GB] United Kingdom ..... 9400635

[51] Int. Cl.[6] ..... D03C 3/40

[52] U.S. Cl. ..... 139/59; 242/596.2; 254/405; 16/225; 139/85

[58] Field of Search ..... 139/65, 59, 85; 254/405; 242/596.2; 16/DIG. 13, 211, 213, DIG. 31, 223, 225; 248/325.1

[56] References Cited

U.S. PATENT DOCUMENTS

| | | | |
|---|---|---|---|
| 2,188,715 | 1/1940 | Ingram | 254/405 X |
| 3,709,445 | 1/1973 | Adams | 242/596.2 |
| 4,325,537 | 4/1982 | Winter et al. | 254/405 |
| 4,682,634 | 7/1987 | Palau et al. | 139/85 |
| 5,222,526 | 6/1993 | Derudder | 139/65 |
| 5,353,846 | 10/1994 | Gheysen et al. | 139/65 |

*Primary Examiner*—Andy Falik
*Attorney, Agent, or Firm*—Klauber & Jackson

[57] ABSTRACT

The double roller elements for Jacquard machines are produced as one piece plastic carcasses each comprising a central body (60) with end plates (64, 66) integrally hinged thereto. The body has hollow spindles (88) to receive the rollers, (94) and once the rollers (94) have been placed on the hollow spindles, the plates (64, 66) are hinged to cover the rollers (94) and plugs (90) snap into the spindles (88). The cords can be snapped past the gaps between the outer peripheries of the plates (64, 66) to couple the cords to or uncouple them from the element, without unplugging the plates (64, 66) from the spindles (88).

10 Claims, 2 Drawing Sheets

DOUBLE ROLLER ELEMENTS FOR JACQUARD MACHINES

FIELD OF THE INVENTION

This invention relates to supporting carcasses for rollers, which are constructed in plastics material.

The carcasses are formed by any suitable production process such as by machining or moulding, typically injection moulding, and serve to provide a means whereby a roller can be readily mounted to perform a particular function.

The invention also extends to the combination of carcasses and rollers supported thereby.

Although not limited thereto, the invention has particular application to the provision of double roller elements for Jacquard machines.

BACKGROUND OF THE INVENTION

Jacquard machines are textile machines which may be used for the weaving of textile materials such as whip cord material or for double shuttle weaving and many Jacquard machines employ what are known as double roller elements.

These double roller elements are located between Jacquard lift bars and the warp threads forming the machine sheds so that, for example, some Jacquard machines which conventionally are two position machines (high shed and low shed) can be converted to three position machines (high shed, middle shed and low shed).

The double roller elements comprise essentially elongated components having rollers at the respective ends thereof and around which connecting cords are trained. The cords which are trained round one of the rollers connect to the lift bars, while the cords which are connected around the rollers at the other ends are connected to the threads which define the warp sheds.

Known double roller elements for this purpose comprise at least six parts, namely two side plates, two guide rollers and their axles. In any particular Jacquard machine there may be vast numbers of such double roller elements and they lie adjacent and in overlapping relationship in a tight pack and it is therefore difficult to change individual double roller elements which have become damaged or worn. The known double roller elements are also expensive and due to the numbers which are used, they are almost as expensive as the Jacquard machine to which they are connected. The known double roller elements typically are made of steel and are comparatively heavy and are not best suited to the high speed movements which are required of these double roller elements. Furthermore the elements tend to collide with one another in use, and a surprisingly high noise level is produced by the elements.

It has been proposed to make double roller elements in plastics material, in order to reduce weight and noise, and in one proposal for a plastic element, the two side members of the element are manufactured in plastics material, and are of identical construction, but to be fitted together they must be turned through 180° relative to one another and then they can be snap fitted, trapping the rollers there between on appropriate axle formations provided in the molding.

These plastic rollers while providing an advance on the heavy steel roller elements, nevertheless have some short comings as related to repair and maintenance thereof. They are difficult to remove from the machine, and the cords cannot be removed from the rollers without prying apart the roller element sides. Due to the environment in which these roller elements are used, this represents a considerable problem because, as mentioned, above the elements are tightly packed in the machine.

Another problem is that if only one roller is to be replaced, the entire element must be opened up and the other roller may fall and become lost.

SUMMARY OF THE INVENTION

The present invention is concerned with the provision of a carcass for supporting a roller, and in accordance-with its most general aspect, the carcass comprises first and second portions of plastics material interconnected by an integral hinge so that the portions can be snap fitted together to define an axle for a roller, and the roller can be placed in position between the portions on the axle before the portions are snapped together.

Integral hinges in plastics material are known, but their use in this particular application provides a considerable advantage. A roller can be readily mounted on an axle and in an accurate position in a simple and effective manner.

One portion of the carcass may be provided with a socket defining the axle outer surface, while the other portion may have a plug which snaps into the socket or spindle when the carcass portions are folded together.

When the invention is applied to a double roller element for a Jacquard machine, specific advantages can be achieved by preferred aspects of the invention thus, there may be a central portion and two end portions with two integral hinges so that the end portions can be snapped into position trapping two rollers in the carcass. The end portions which are snapped into position may be designed so as to have sufficient flexibility and clearance to enable the cords which in the Jacquard machine are trained round the rollers to be pryed or snapped clear of the double roller element without having to unfold the end portions about the integral hinges.

By simple means, extremely effective double roller elements for a Jacquard machine are created. It is recognized that the invention can be applied in other applications where a roller is to be readily and quickly accommodated in a particular position on a pin, sties material carcass.

DETAILED DESCRIPTION OF THE INVENTION

Figure 1:
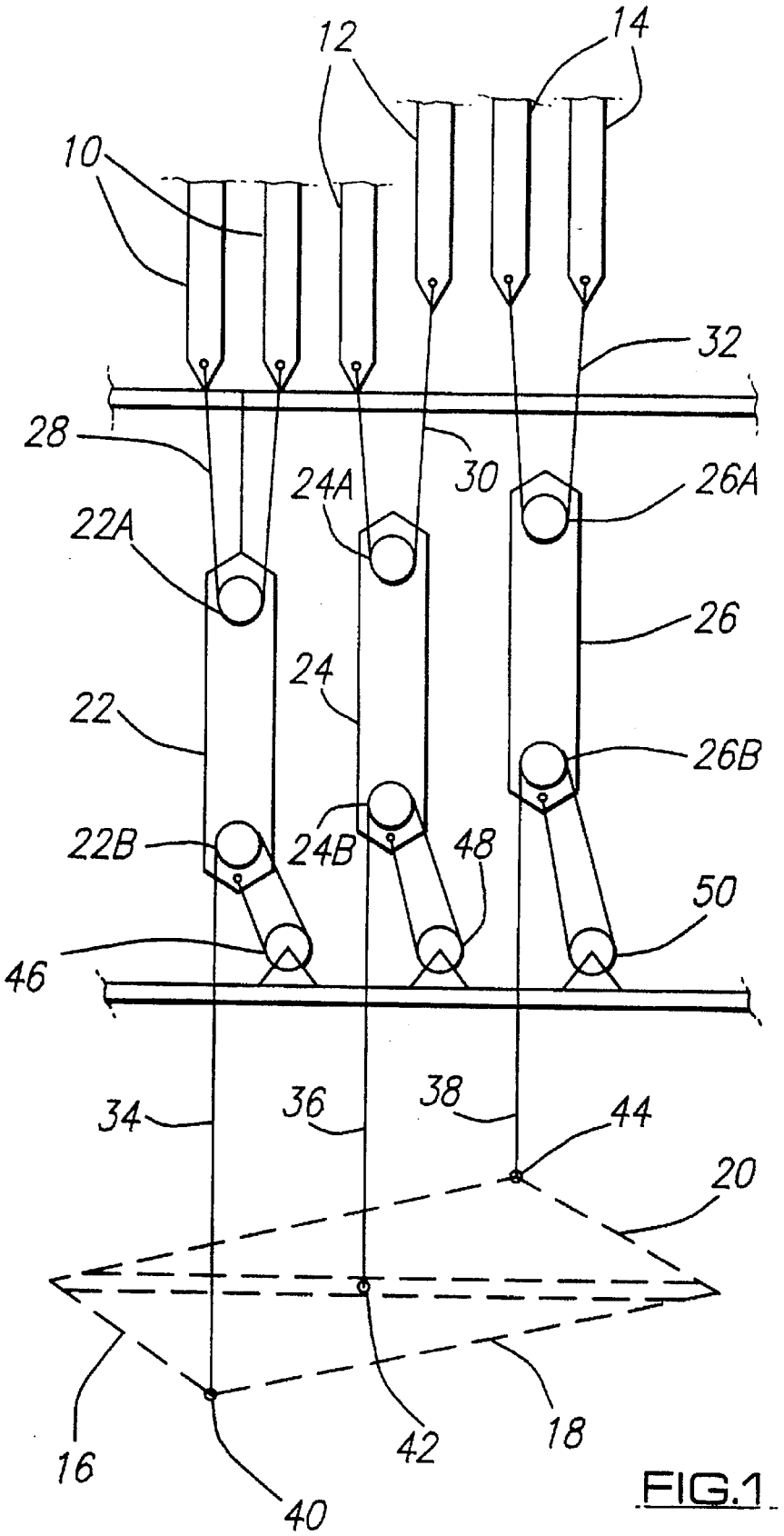
FIG. 1 a diagrammatic view of certain components of a Jacquard machine employing double roller elements.

Referring to FIG. 1, which is a diagrammatic illustration, certain key parts of a Jacquard machine are shown, and these parts comprise lift bar pairs 10, 12 and 14, the raising and lowering of which by appropriate control means not shown effect the formation of sheds in weft threads 16, 18 and 20, as is well known. The bars 10, 12 and 14 are connected to double roller elements 22, 24 and 26 in that each of said elements has rollers 22A, 22B, 24A, 24B and 26A, 26B at the ends thereof, and cords 28, 30 and 32 having their respective ends connected to the bar pairs 10, 12 and 14 are trained round the rollers 22A, 24A and 26A as shown.

Further cords 34, 36 and 38 are trained round the rollers 22B, 24B and 26B as shown and one end of each cord is connected to a weft shed as shown at 40, 42 and 44, whilst the other end of each of the cords 34, 36 and 38 is connected to the associated double roller element 22, 24, 26 at its end adjacent its roller 22B, 24B and 26B after passing round a return pulley 46, 48 and 50.

Figure 2:
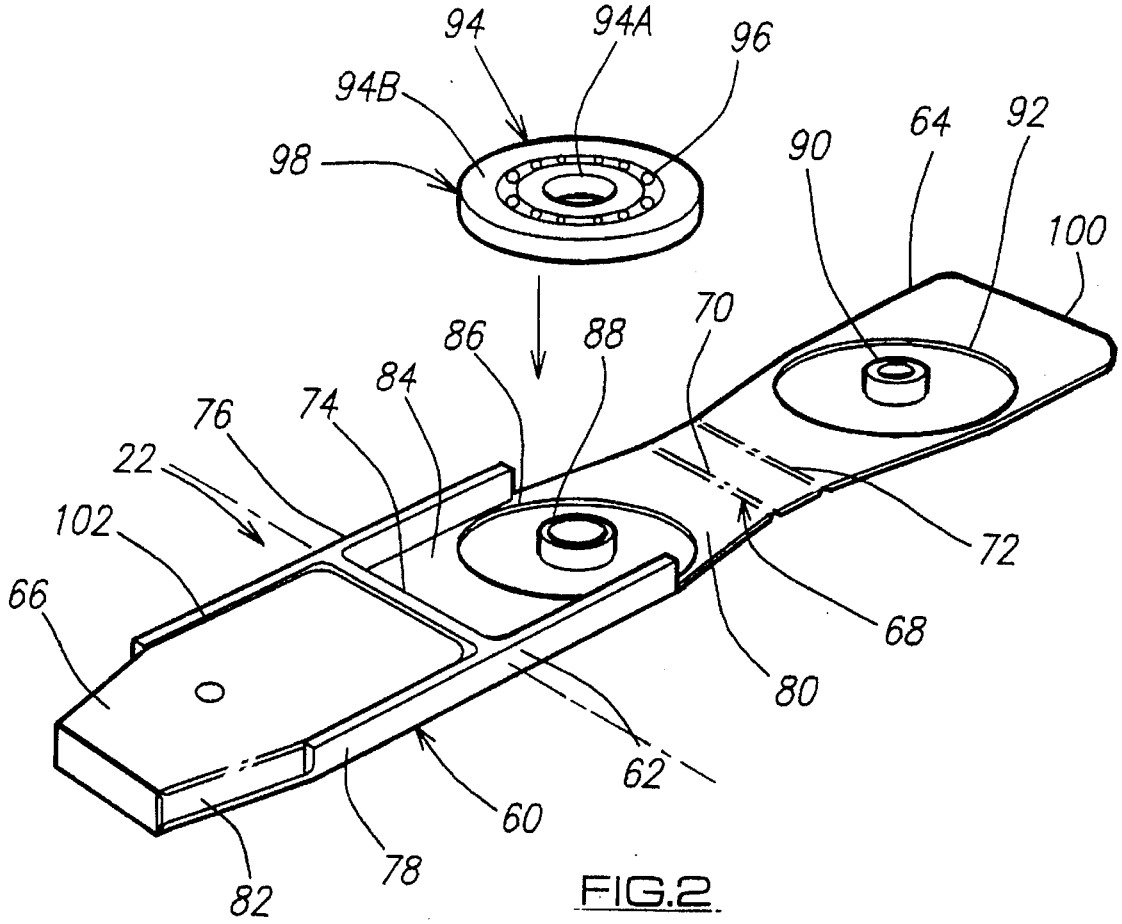
FIG. 2 is a perspective view of one of the double roller elements, the view partly being in exploded form to illustrate one of the rollers.

The arrangement illustrated in FIG. 1 is well known and also known are double roller elements which are used in the positions illustrated by elements 22, 24 and 26. The present invention is not concerned with the Jacquard machine per se and its method of operation but it is concerned with the construction of the roller elements 22, 24 and 26. It is mentioned therefore at this time that the roller elements 22, 24 and 26 of which an example is illustrated in FIG. 2, can be used in connection with Jacquard machines which are set up to perform other functions. Jacquard machines can be used for creating a wide range of woven patterns, and we are particularly concerned with machines which are set up for introducing single woven letters into a relatively wide cloth. Such a machine requires a Jacquard harness to all points across the width of the cloth which results in extremely close packing of the double roller elements into a small space. The double roller elements may be in the order of tens of rows deep.

Reference is now made to FIG. 2 which shows, for example, a double roller element 22. This element consists of a plastics moulded carcass 60 comprising a central body portion 62 and two end portions 64 and 66 which are hinged to the ends of the central body portion 62 by an integral hinge arrangement 68 made up of parallel integral hinges 70, 72.

The central body portion 60 is provided with a central raised partition flange 74 and side flanges 76 and 78 which are of the same height as the partition flange 74. The flanges 76 and 78 do not extend for the full length of the body portion 60 so that there are defined tail portions 80 and 82 of the base plate 84 of the body and it is to these tails that the end portions 64 and 66 are connected.

The base plate is provided on each side of the partition 74 with a shallow recess 86 of circular form, and in the center of which is an upstanding socket or spindle 88 which is cylindrical and serves to receive a plug 90 on the end portion 64/66. The portion 64/66 also has a circular shallow recess 92 concentric with the plug 90. The element 33 is symmetrical about a central transverse axis passing through the central raised partition flange 74, on opposite sides of which the rollers lie.

The socket 88 serves to define an axle for a roller bearing 94 which typically comprises plastic inner and outer races 94A and 94B between which are rolling elements such as balls 96. Any type of roller may be used as required.

The outer periphery of the outer race 94B is grooved at 98 to receive the cord 28 or 34 as previously described.

To assemble the double roller element of FIG. 2 is an extremely simple matter insofar as the carcass is laid out with the end portions 64 and 66 unfolded from the body portion 62 (in the manner as shown by portion 64) and two rollers are placed on the respective sockets 88. The portions 64 and 66 are then fastened to the body by being folded over and snapped into position by pressing the plugs 90 into the centers of the sockets or spindles 88 leaving spaces for the cords to pass freely round the rollers. The cords can be trained round the rollers 94 before or after (as explained herein) the portions are snapped into position. The rollers are thereby trapped, and the outer periphery 100 of each of the portions 64 and 66 is shaped and profiled so as to leave a clearance 102 in relation to the flanges 74 and 76 so that in fact the cords which are trained round the rollers 94 can be snapped past the profiled edge 100 and into or out of the double roller element without having to unfasten the portions 64 and 66.

The cords may be fitted around the rollers 94 prior to the snapping closed of the portions 64 and 66 when the double roller elements are initially installed.

The item shown in FIG. 2 is, of course, a one-piece item, except for the rollers 94, so there manufacture and assembly is particularly simple.

The advantage of the arrangement described in relation to Jacquard machines is that the cords technically do not have to be threaded through the elements prior to being fitted to the Jacquard machine and there is no problem if a single element needs to be changed as a result of breakage, which is normally a time consuming operation as it is difficult to perform due to the extremely restricted space available. Considerable savings in time required for machine servicing and refurbishment are achieved when the elements are replaced, as it is not necessary to remove the cords from the machine.

Also, it is easy to change only one or more rollers of any of the elements, if the entire element does not have to be replaced, as either end portion 64 and 66 can be opened and the appropriate roller removed. Broken cords can be easily replaced and filled without removing or opening the elements.

The double roller element as described in relation to FIG. 2 is not only a one-piece design, but is also single sided. The element could be fitted to the Jacquard machine in the open form, with bearings 94 appropriately fitted. The element could be hung over the top cord and the hinged end snapped closed. The bottom cord could be similarly fitted followed by the closing of the bottom end of the element. To remove the element from the cords simply requires the cord to be pulled past the flexible edge of the portions 64 and 66, and the removed element may then be opened allowing the fitting of new bearings. Such refurbishment and repair methods are not possible with the conventional double roller elements.

I claim:

1. A roller element for a Jacquard machine, said roller element comprising:

a) an elongated plastics material body comprising a middle region between two end portions;

b) two cord receiving rollers;

c) two cover plates;

d) means for connecting the cover plates to respective ends of the body;

e) means for receiving the respective rollers and defining spindles therefor: said means for receiving being disposed in the middle region of the body and between the rollers; and f) gaps between the plates and body enabling cords on the rollers to be looped over the plates for the disconnection of the roller element from the Jacquard machine.

2. An element according to claim 1 wherein the plates include plug means for being snap fitted to the spindles defined in the middle region.

3. An element according to claim 1 or 2 wherein the plates are integrally connected to the respective parts of the body via integral hinges whereby the body and the plates form a one piece carcass.

4. An element according to claim 1 or 2 wherein the spindles in the middle region have bores and the plug means further comprising plugs which are removably received in the bores in the spindles.

5. An element according to claim 1 or 2 wherein the edges of the plates are shaped so as to lie adjacent to the insides of partitions on the body with a clearance through which the cords can be snapped, thereby forming said gaps.

6. An element according to claim 1 or 2 wherein the element is symmetrical about a central transverse axis on opposite sides of which the rollers lie.

7. A roller element carcass for a roller element for a Jacquard machine, comprising an elongated body of plastics material, two cover plates respectively integrally hinged to the ends of said body, means on the body and-cover plates enabling the cover plates to be hinged onto and snap fitted to the body, said means also defining spindles for the receipt of cord receiving rollers.

8. A roller element for a Jacquard machine, said roller element having two cord receiving rollers, and wherein the respective cord receiving rollers are trapped between a plastics material body and cover plate means which cover plate means serves to retain cords on the rollers, characterized in that the cover plate means comprises two cover plates, which are integrally connected to the body via integral hinges whereby the body and the plates form a one piece carcass, and the assembly of the element is effected by placement of the rollers followed by the holding of the plates into position trapping said rollers.

9. An element according to claim 8, wherein the body has spindles receiving the rollers and the plates have plugs which are removably received in bores in the spindles.

10. An element according to claim 8 or 9 wherein the element is symmetrical about a central transverse axis on opposite sides of which the rollers lie.

* * * * *